United States Patent [19]

Ketterer

[11] Patent Number: 4,535,711

[45] Date of Patent: Aug. 20, 1985

[54] LOOPER-CAM SHIFTING ARRANGEMENT FOR A SEWING MACHINE

[75] Inventor: Stanley J. Ketterer, Jamesburg, N.J.

[73] Assignee: The Singer Company, Stamford, Conn.

[21] Appl. No.: 660,167

[22] Filed: Oct. 12, 1984

[51] Int. Cl.[3] ..... D05B 57/02; D05B 97/02; D05B 97/10

[52] U.S. Cl. ..... 112/199; 112/112; 112/169; 112/311

[58] Field of Search ..... 112/112, 169, 199, 303, 112/311, 320

[56] References Cited

U.S. PATENT DOCUMENTS

| | | | |
|---|---|---|---|
| 3,165,080 | 1/1965 | Castelletti | 112/112 |
| 4,411,210 | 10/1983 | Killinger | 112/199 |
| 4,463,695 | 8/1984 | Killinger | 112/199 |

*Primary Examiner*—Wm. Carter Reynolds
*Attorney, Agent, or Firm*—William V. Ebs; Robert E. Smith; Edward L. Bell

[57] ABSTRACT

A hand operated sewing machine with opposing loop seizing points for forming chain stitches. A work feeding plate reciprocates with a plate member about a pivot. A flexible upstanding portion at one end of an arm is biassed by the moving plate member causing the other arm end to bias a cam affixed to the loop seizing points. This bias determines the cam path taken by a drive pin that provides motion to the loop seizing points.

5 Claims, 10 Drawing Figures

LOOPER-CAM SHIFTING ARRANGEMENT FOR A SEWING MACHINE

BACKGROUND OF THE INVENTION

1. Field of the Invention

The invention relates to chain stitch sewing machines with double pointed loopers.

2. Description of the Prior Art

Single thread chain stitch, button sewing or tacking machines may include a double pointed looper, a cam to which the looper is attached, an actuator operable along intersecting tracks in the cam for positioning the looper for cooperation with a sewing needle in the formation of chain stitches, and a gate for controlling movement of the actuator between cam tracks. Such a machine may be seen, for example, in the copending patent application of Karl Hugo Killinger for "Feeding Mechanism for Double Pointed Looper Sewing Machine", Ser. No. 461,825, filed Jan. 28, 1983, now U.S. Pat. No. 4,463,695.

It is a prime object of the present invention to simplify the construction and improve the operational reliability of a machine of the described type.

It is also an object of the invention to eliminate the gate from such a machine, and so provide room for modified cam tracks enabling looper points to be moved into needle thread loops before they can twist or collapse.

More particularly, it is an object of the invention to provide improved means for controlling the movemement of an actuator between the cam tracks of a looper-cam assembly in such machine.

Other objects and advantages of the invention will become apparent during a reading of the specification taken in connection with the accompanying drawings.

SUMMARY OF THE INVENTION

A sewing machine according to the invention has a longitudinally extending bed on which work is fed transversely by work moving means including a longitudinally extending member that is operably connected to a driving member for actuation thereby and is mounted in the frame of the machine for pivotal reciprocable movement about an axis extending perpendicular with respect to the bed. An arm with a resiliently flexible portion is connected at one end to the pivotable reciprocable member for positioning thereby, and at the other end to a looper-cam assembly for biasing the looper-cam assembly in opposite directions, according to the position of the said pivotable reciprocable member, to thereby control movement of an actuator for the looper-cam assembly between intersecting tracks in the cam, and so assure movement of looper points as required for cooperation with a sewing needle in the formation of chain stitches.

DESCRIPTION OF THE INVENTION

Figure 1:
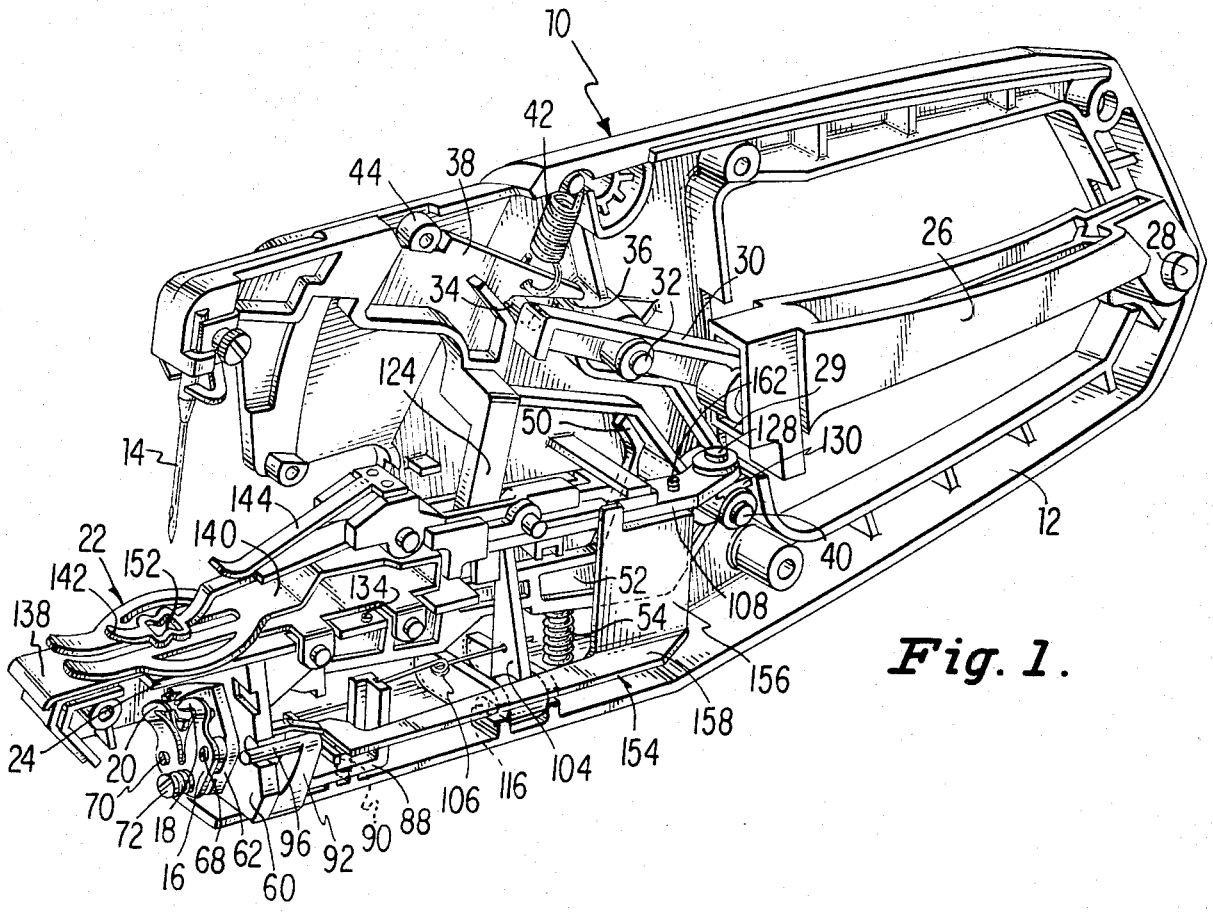
FIG. 1 is a perspective side view showing a machine according to the invention.
Figure 2:
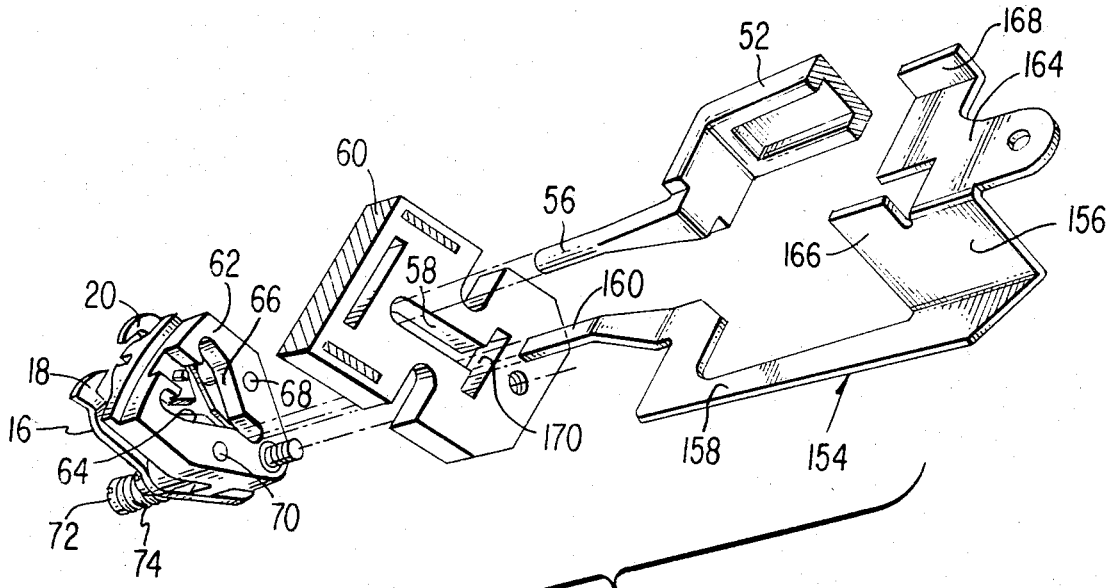
FIG. 2 is a fragmentary exploded perspective view showing cam-looper actuating and biasing mechanism included in the machine of FIG. 1.
Figure 3:
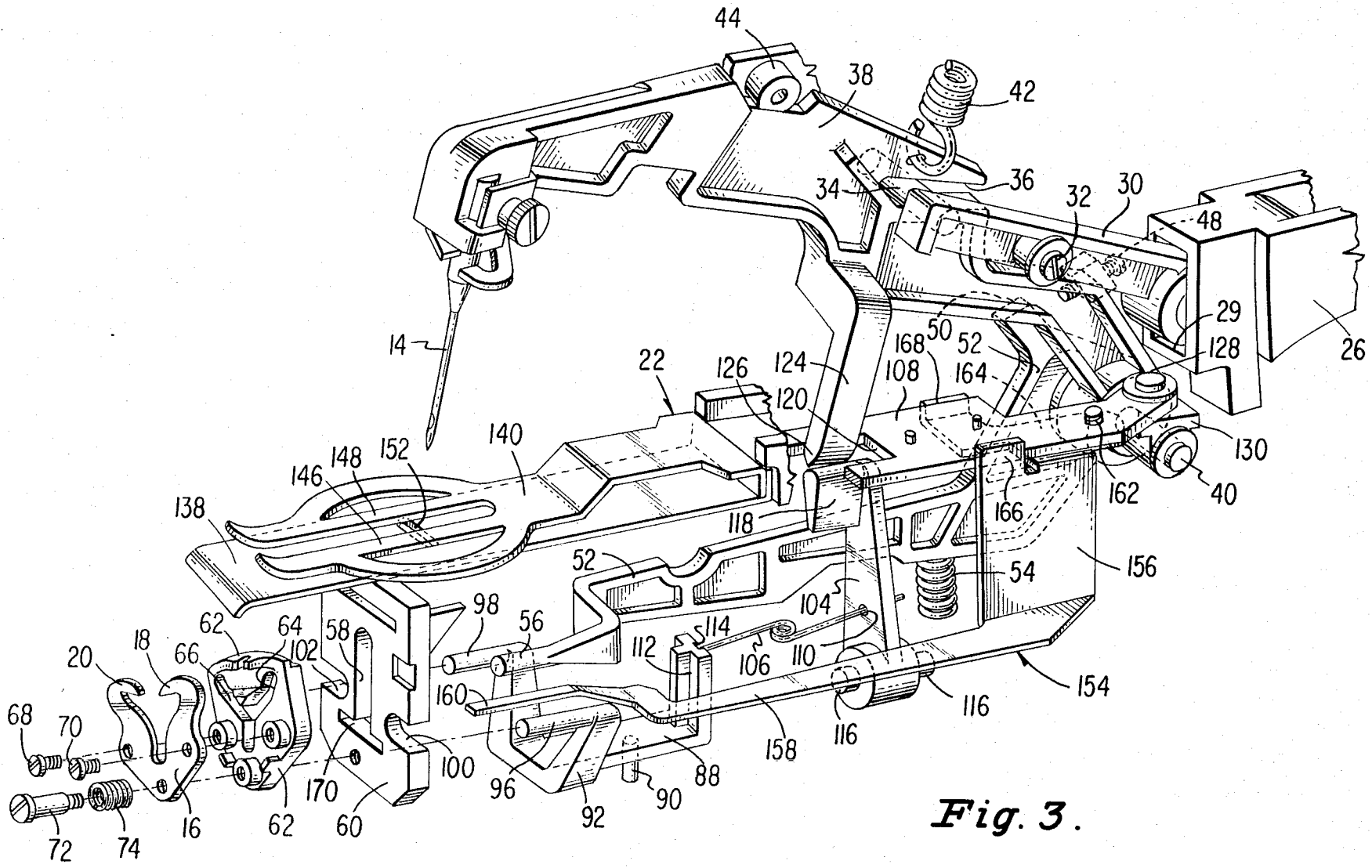
FIG. 3 is a partially exploaded perspective view showing portions of the machine.

Referring to the drawings, there is shown a hand held button sewing machine 10 according to the invention, including a frame 12, a thread carrying needle 14 arranged for reciprocating movement and a pivotally movable looper 16 with opposing loop seizing points 18 and 20 which cooperate with the needle in the formation of chain stitches. A work clamping assembly 22, which is supported on a longitudinally extending bed 24, is arranged to undergo movements in cooperation with those of the needle 14 and the looper to properly position a button which is to be sewed to a work piece. A hand operated driving member shown as a lever 26 with one end pivotally attached at 28 to the frame 12 is interconnected with the needle 14 and clamping assembly 22 to impart the desired movements thereto. The hand operated lever 26 also imparts movement to the looper 16.

As shown, lever 26 connects in a slot 29 with one end of the link 30 which is pivotally mounted on a pin 32 affixed in frame 12. A free end of link 30 includes a laterally extending pin 34 that extends into a slot 36 in an arm 38 which carries needle 14 at one end and is pivotally mounted at the other end on a shaft 40 affixed in the frame 12. Arm 38 is biased upwardly by spring 42 into engagement with a stop 44. The arm is caused to move downwardly and dispose needle 14 for cooperation with looper 16 whenever lever 26 is squeezed upwardly. When lever 26 is released, the arm is returned to a position of engagement with stop 44 by spring 42.

Arm 38 carries a depending adjustable screw 48 which is caused during a latter portion of the descent of arm 38 to engage an abutment 50 on a looper drive arm 52, and move the drive arm downwardly about one end pivoted on shaft 40 against the bias of a spring 54. Spring 54 moves arm 52 upwardly as arm 38 is moved upwardly following the release of lever 26. A drive pin 56 projects outwardly from the free extremity of arm 52 and extends through an inverted T-shaped slot 58 in a guide block 60 which is rigidly attached to frame 12. Pin 56 extends beyond block 60 to engage a cam 62 along intersecting cam tracks 64 and 66 thereon. Looper 16 is affixed to cam 62 with screws 68 and 70, and the assembly is mounted on block 60 with a shouldered screw 72 and spring 74 for pivotal movement on the screw 72. During operation of the machine, drive pin 56 is moved up and down by arm 52 and acts against cam tracks 64 and 66 to pivotally tilt the looper 16 as required to alternately place each of the two loop seizing points 18 and 20 on the looper into cooperative association with the needle 14 to provide for the formation of chain stitches. Movement of pin 56 between the cam tracks is controlled as described hereinafter.

The machine 10 is provided with mechanism for imparting reciprocating movement to work under the needle 14. Such mechanism includes a lever 88 which is pivotally mounted on a pin 90 in frame 12, and has a member 92 affixed thereon. Member 92 includes fingers 96 and 98 that extend through slots 100 and 102, respectively, in block 60 to engage opposite sides of cam 62. The feeding mechanism further includes a feed pawl 104, a wire spring 106 which connects lever 88 with the feed pawl, and a member 108 extending longitudinally in the mechanism and having the clamping assembly 22 cemented or otherwise suitably secured thereto. As shown, one end of spring 106 extends through a hole 110 in pawl 104 and the other end of the spring extends through a slot 114 in an upstanding end portion 112 of lever 88. The lower end of the pawl is pivoted at 116 in the frame, and a wedge-shaped upper end portion 118 projects into an opening 120 in member 108. The width of opening 120 is sufficient to accommodate the upper end portion 118 of pawl 104 as well as a depending plunger 124 on arm 38 movable into and out of the opening as the arm is caused to pivot on shaft 40. Plunger 124 has a lower wedge-shaped end portion 126 as shown.

While the needle carrying arm 38 is in a raised position, the looper affixed cam 62 is in an extreme pivoted position against finger 96 or 98, and lever 88 is disposed to cause spring 106 to hold end portion 118 of pawl 104 against one side or the other or opening 120 as determined by the position of cam 62. When arm 38 is moved downwardly by the squeezing of lever 26, plunger 124 is caused to move into opening 120. As the plunger 124 moves into opening 120, wedge edge portion 126 pushes against feed pawl 104, whereupon the pawl is caused to pivot member 108 and clamping assembly 22 attached thereto about an axis extending perpendicular to bed 24 as defined by a fixed pin 128 in a stationary boss 130. Member 108 is a rigid plate-like member slidable on bed 24 between transversely spaced stops 134 (of which only one may be seen in FIG. 1 of the drawings). Work clamping assembly 22 is shown as including a fabric supporting feeding plate 138, a resilient forked member 140 for bearing down on and holding fabric against plate 138, and a button clamping member 142 biased downwardly by a spring 144 for holding a button on portions 146 and 148 of the member 140 over the fabric. Fabric and a button held in the clamping assembly are moved laterally under the needle by the described movement of assembly 22, to dispose the button for needle penetration through one buttonhole of a pair of spaced buttonholes. Member 108, the clamping assembly 22, and bed 24 include aligned openings at 152 through which the needle 14 can pass in laterally displaced positions of the member and clamping assembly.

After the initial downstroke of arm 38 and upon the release of lever 26, arm 38 is moved upwardly by spring 42 to withdraw needle 14 from the work in clamp 22, and plunger 124 from opening 120. During such upward movement, looper affixed cam 62 is pivoted by drive pin 56 away from the then engaged finger on member 92, and into enforced engagement with the other finger. Lever 88 is moved to stress spring 106 in a manner causing pawl 104 to be biased against plunger 124, and when the plunger clears the pawl, the stored energy in the spring is released whereupon the pawl is moved by spring action from the one side of opening 120 to the other.

During the next downstroke of arm 38 occasioned by the squeezing of lever 26, plunger 124 acts against upper portion 118 of pawl 104 on the side opposite from that engaged by the plunger during its initial downstroke. As a consequence, the pawl is caused to move member 108 and attached clamping assembly 22 along with the work held thereby in a direction opposite to the direction in which they were moved during the initial downstroke, and the button is repositioned for needle penetration of a second buttonhole of a buttonhole pair.

As the arm 38 is again moved upwardly upon the release of lever 26 to thereby withdraw needle 14 from the work and plunger 124 from opening 120, looper affixed cam 62 is pivoted by drive pin 56 away from the engaged finger on member 92 and into enforced engagement with the other finger. Lever 88 is moved to stress the spring 106 while pawl 104 is still in engagement with plunger 124 and when the plunger clears the pawl the spring moves the pawl across opening 120 to its initial position to complete an operating cycle of the machine. Such operating cycle is repeated as many times as required to securely fasten the button to the underlying fabric.

As noted hereinbefore, drive pin 56 is moved up and down by arm 52 during operation of the machine and acts against tracks 64 and 66 in cam 62 to tilt, and so alternately place each of the two loop seizing points 18 and 20 on the looper into cooperative association with needle 14 to provide for the formation of chain stitches. The drive pin 56 moves in the cam tracks as shown in FIGS. 4 through 10. Movement of the drive pin between the cam tracks 64 and 66 is controlled by an arm 154 which is operably connected at one end to member 108 and at the other end to cam 62.

As shown, arm 154 includes an upstanding portion 156, as well as an elongate portion 158 which extends longitudinally in the frame 12 of the machine from portion 156 and terminates in a tongue 160. The arm is connected to member 108 for positioning thereby with a screw 162 extending through a right angle flange 164 on the arm, and by way of tabs 166 and 168 thereon which bracket member 108. Tongue 160 projects through a lateral portion 170 of slot 58 in guide block 60 and into the lower end of a connecting space 172 in cam 62 between cam tracks 64 and 66. Ample room is provided in slot portion 170 in guide block 60 for lateral movement of the tongue, however, the tongue fits snuggly into the lower end of space 172 in cam 62. Arm 154 is formed from sheet material which is resiliently flexible in a direction perpendicular to the plane of the sheet, but which stiffly resists flexure in the plane of the material, sheet steel being preferable for use in the formation of the part.

Just prior to each downward movement of drive pin 56, in one or the other of the tracks in cam 62, arm 154 is stressed by the positioning of member 108 as described hereinbefore, and the upstanding portion 156 which is perpendicular to member 108 is caused to flex. Elongate portion 158 of the arm, including the tongue 160 which is then held stationary in the cam and caused to apply a biasing force thereto, is formed to extend perpendicular to portion 156 and therefore remains substantially rigid.

Figure 4:
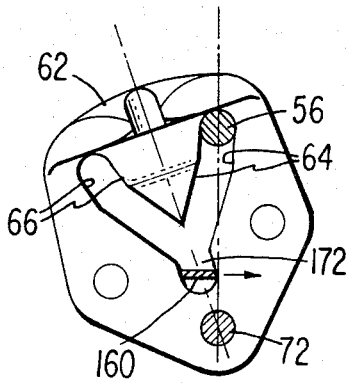
FIGS. 4 through 10 are end views of the looper-cam assembly of the machine as seen in various operating positions.
Figure 5:
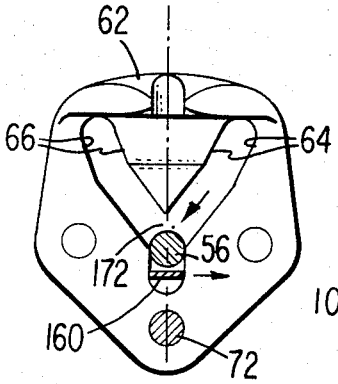
Figure 6:
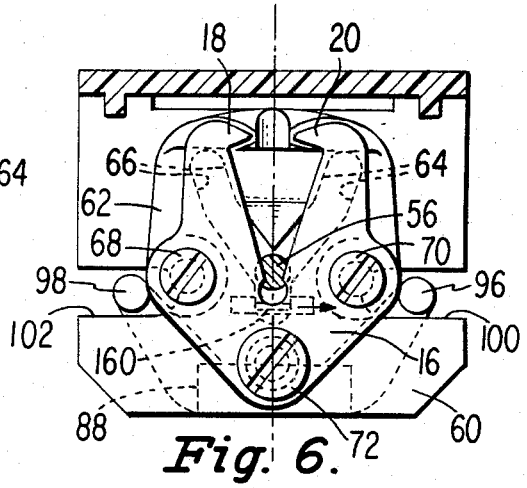
Figure 7:
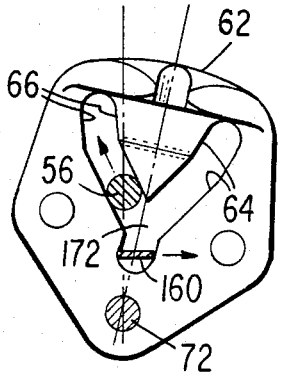
Figure 8:
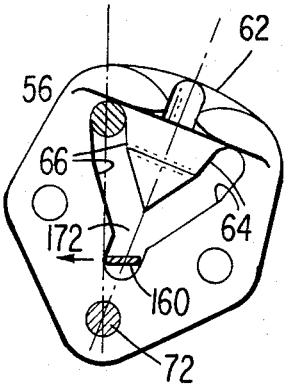
Figure 9:
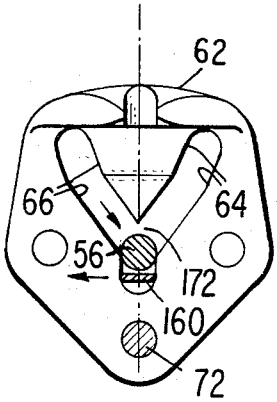
Figure 10:
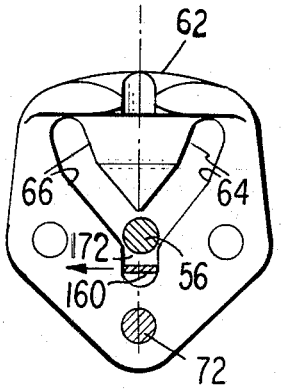

Referring to FIG. 4, wherein pin 56 is shown in the upper end of track 64 and cam 62 is tilted to the left, tongue 160 may be seen acting in a direction opposite to the then tilted direction of the cam. As pin 56 is moved downwardly in track 64, the cam and attached looper is pivoted to an upright position (FIG. 5). The pin is moved into the lower end of connecting space 172 between tracks 64 and 66 wherein the tongue 160 is located and is then moved upwardly. As the pin moves upwardly (FIG. 6) through space 172 common to both tracks, the cam is no longer under the control of pin 56 and is pivoted by the biasing force exerted by the tongue to assure movement of the pin into track 66. The pin proceeds in track 66 (FIG. 7) toward the upper end causing the cam-looper assembly to tilt to the right. Downward movement of the pin 56 in track 66 is preceeded by another positional change of member 108 as described causing reversed flexure of upstanding arm portion 156, and the application by tongue 160 of a biasing force to the left on cam 62 (FIG. 8). As the pin moves downwardly in track 66, the cam-looper assembly is moved to an upright position (FIG. 9). The pin moves into the lower end of space 172 over tongue 160, and is then moved upwardly through space 172 (FIG. 10) where the cam is no longer under the control of the pin whereupon the cam is pivoted leftward by the tongue 160 to assure movement of the pin into track 64. When the pin reaches the upper end of track 64 (FIG. 4) the described operations are repeated with continued operation of the machine.

It is to be understood that the present disclosure relates to a single embodiment of the invention which is for purposes of illustration only, and is not to be construed as limiting the invention. Numerous alternations and modifications of the structure herein will suggest themselves to those skilled in the art, and all such modifications and alterations which do not depart from the spirit and scope of the invention are intended to be included within the scope of the appended claims.

I claim:

1. In a sewing machine; a frame; a driving member; a needle; means operably connected to the driving member for reciprocating the needle; a looper and cam assembly mounted for pivotal movement on the frame in a plane extending transversely therein, the looper being formed with a pair of loop seizing points and the cam including a pair of intersecting cam tracks; a longitudinally extending actuator in the frame operably connected to the driving member and engageable with the cam on said cam tracks for imparting pivotal movement to said assembly and disposing the looper points for cooperation with the needle in the formation of chain stitches; a longitudinally extending bed; means for moving work laterally on the bed including a longitudinally extending member which is operably connected to said driving member for actuation thereby and is mounted in the frame for pivotal reciprocable movement about an axis extending perpendicular with respect to the plane of the bed; and an arm including a resiliently flexible portion, the arm being operably connected at one end to the longitudinally extending pivotable reciprocable member for flexure thereby, and at the other end to the looper-cam assembly for biasing the looper-cam assembly in opposite directions according to the position of the longitudinally extending pivotably reciprocable member to thereby control movement of the said actuator between the cam tracks.

2. The combination of claim 1 wherein said other end of the arm extends into a connecting space between the cam tracks.

3. The combination of claim 1 wherein the arm is a sheet metal part which is of a resilient material, and which includes both said resiliently flexible portion and another portion which by being formed in a plane perpendicular to the plane of the flexible portion is caused to remain rigid during flexure of the arm by the longitudinally extending pivotably reciprocable member.

4. The combination of claim 3 wherein the arm includes a tongue which projects into a connecting space between the cam tracks.

5. The combination of claim 4 wherein the tongue is an extension of said another portion of the arm.

* * * * *